US006547411B1

(12) United States Patent
Dornbusch

(10) Patent No.: US 6,547,411 B1
(45) Date of Patent: Apr. 15, 2003

(54) ILLUMINATED OUTLET

(76) Inventor: Timothy J. Dornbusch, 1021 Academy Ave. Apt #2, Cincinnati, OH (US) 45205

( * ) Notice: Subject to any disclaimer, the term of this patent is extended or adjusted under 35 U.S.C. 154(b) by 0 days.

(21) Appl. No.: 09/991,175

(22) Filed: Nov. 16, 2001

(51) Int. Cl.[7] ..... F21V 33/00; F21V 23/04

(52) U.S. Cl. ..... 362/95; 362/85; 362/276; 362/802

(58) Field of Search ..... 362/95, 85, 276, 362/802, 253, 226

(56) References Cited

U.S. PATENT DOCUMENTS 2,749,428 A * 6/1956 McCarthy ..... 362/95
3,739,226 A 6/1973 Seiter et al.
3,860,829 A 1/1975 Fabbri
4,000,405 A * 12/1976 Horwinski ..... 362/95
5,670,776 A * 9/1997 Rothbaum ..... 362/95
5,683,166 A 11/1997 Lutzker
6,000,807 A 12/1999 Moreland
6,010,228 A 1/2000 Blackman et al.
6,386,725 B1 * 5/2002 Amburgey ..... 362/95

* cited by examiner

*Primary Examiner*—Thomas M. Sember

(57) ABSTRACT

An illuminated outlet for providing an illuminated electrical outlet that illuminates a surrounding area to allow visibility at night. The illuminated outlet includes a body member having a light emitting member. The light emitting member is operationally coupled to a power service for a building. The light emitting member emits light to illuminate the body member when the light emitting member is supplied with power from the power service. The body member is designed for coupling to a wall of the building. A face plate of the body member has a plurality of apertures. The apertures are designed for operationally coupling to the power service whereby the apertures are for permitting a plug of an appliance to be operationally coupled to the power service.

12 Claims, 4 Drawing Sheets

ILLUMINATED OUTLET

BACKGROUND OF THE INVENTION

1. Field of the Invention

The present invention relates to night lights and more particularly pertains to a new illuminated outlet for providing an illuminated electrical outlet that illuminates a surrounding area to allow visibility at night.

2. Description of the Prior Art

The use of night lights is known in the prior art. More specifically, night lights heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,683,166; 4,000,405; 3,739,226; 6,000,807; 6,010,228; and 3,860,829.

While these devices fulfill their respective, particular objectives and requirements, the aforementioned patents do not disclose a new illuminated outlet. The inventive device includes a body member having a light emitting member. The light emitting member is operationally coupled to a power service for a building. The light emitting member emits light to illuminate the body member when the light emitting member is supplied with power from the power service. The body member is designed for coupling to a wall of the building. A face plate of the body member has a plurality of apertures. The apertures are designed for operationally coupling to the power service whereby the apertures are for permitting a plug of an appliance to be operationally coupled to the power service.

In these respects, the illuminated outlet according to the present invention substantially departs from the conventional concepts and designs of the prior art, and in so doing provides an apparatus primarily developed for the purpose of providing an illuminated electrical outlet that illuminates a surrounding area to allow visibility at night.

SUMMARY OF THE INVENTION

In view of the foregoing disadvantages inherent in the known types of night lights now present in the prior art, the present invention provides a new illuminated outlet construction wherein the same can be utilized for providing an illuminated electrical outlet that illuminates a surrounding area to allow visibility at night.

The general purpose of the present invention, which will be described subsequently in greater detail, is to provide a new illuminated outlet apparatus and method which has many of the advantages of the night lights mentioned heretofore and many novel features that result in a new illuminated outlet which is not anticipated, rendered obvious, suggested, or even implied by any of the prior art night lights, either alone or in any combination thereof.

To attain this, the present invention generally comprises a body member having a light emitting member. The light emitting member is operationally coupled to a power service for a building. The light emitting member emits light to illuminate the body member when the light emitting member is supplied with power from the power service. The body member is designed for coupling to a wall of the building. A face plate of the body member has a plurality of apertures. The apertures are designed for operationally coupling to the power service whereby the apertures are for permitting a plug of an appliance to be operationally coupled to the power service.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new illuminated outlet apparatus and method which has many of the advantages of the night lights mentioned heretofore and many novel features that result in a new illuminated outlet which is not anticipated, rendered obvious, suggested, or even implied by any of the prior art night lights, either alone or in any combination thereof.

It is another object of the present invention to provide a new illuminated outlet which may be easily and efficiently manufactured and marketed.

It is a further object of the present invention to provide a new illuminated outlet which is of a durable and reliable construction.

An even further object of the present invention is to provide a new illuminated outlet which is susceptible of a low cost of manufacture with regard to both materials and labor, and which accordingly is then susceptible of low prices of sale to the consuming public, thereby making such illuminated outlet economically available to the buying public.

Still yet another object of the present invention is to provide a new illuminated outlet which provides in the apparatuses and methods of the prior art some of the advantages thereof, while simultaneously overcoming some of the disadvantages normally associated therewith.

Still another object of the present invention is to provide a new illuminated outlet for providing an illuminated electrical outlet that illuminates a surrounding area to allow visibility at night Yet another object of the present invention is to provide a new illuminated outlet which includes a body member having a light emitting member. The light emitting member is operationally coupled to a power service for a building. The light emitting member emits light to illuminate the body member when the light emitting member is supplied with power from the power service. The body member is designed for coupling to a wall of the building. A face plate of the body member has a plurality of apertures. The apertures are designed for operationally coupling to the power service whereby the apertures are for permitting a plug of an appliance to be operationally coupled to the power service.

Still yet another object of the present invention is to provide a new illuminated outlet that provides a night light to illuminate an area around the body member to facilitate uninhibited movement of the user in the dark.

Even still another object of the present invention is to provide a new illuminated outlet that provides a softened emitted light that does not disturb the developing eye sight of a child.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
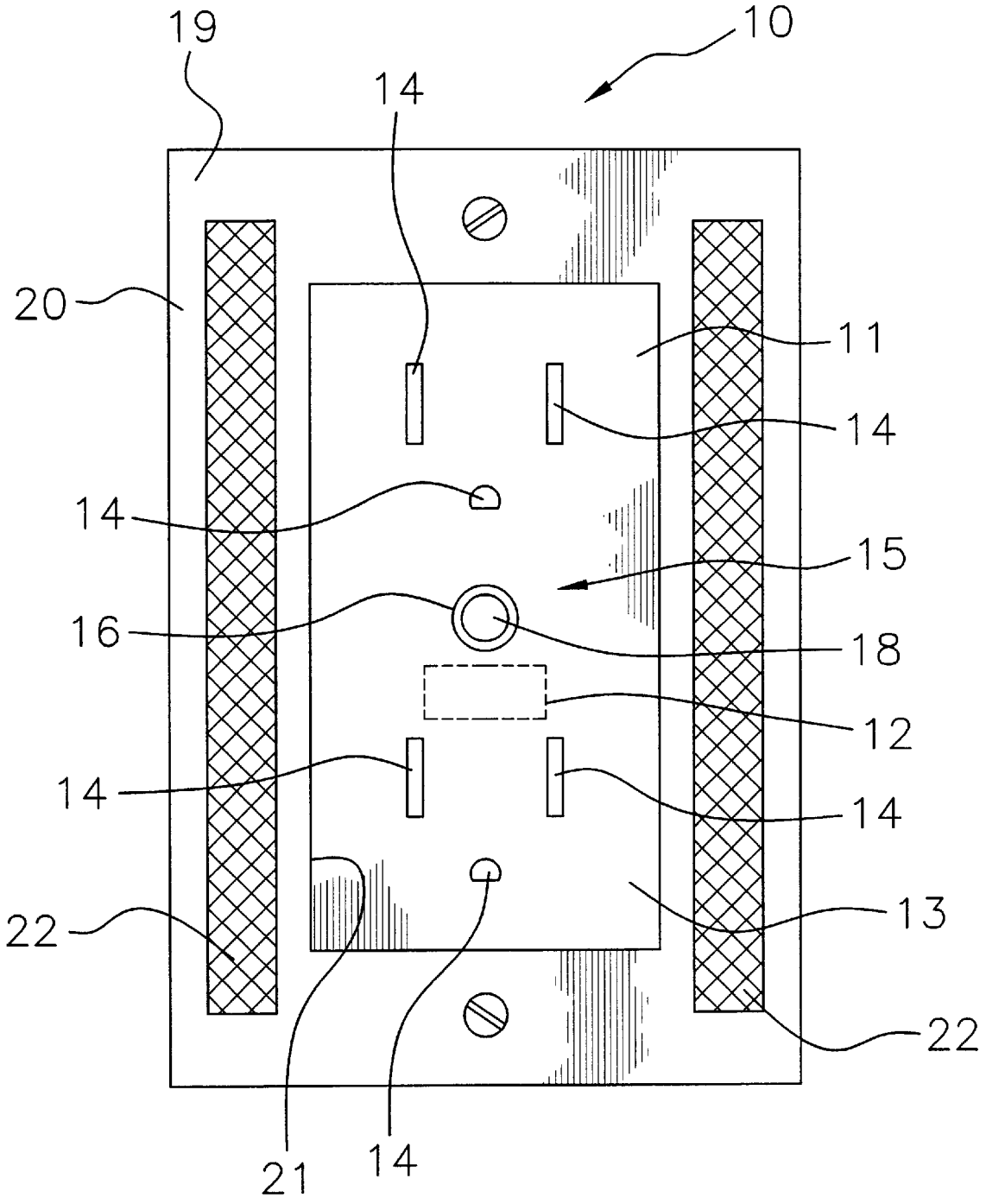
FIG. 1 is a front view of a new illuminated outlet according to the present invention.
Figure 2:
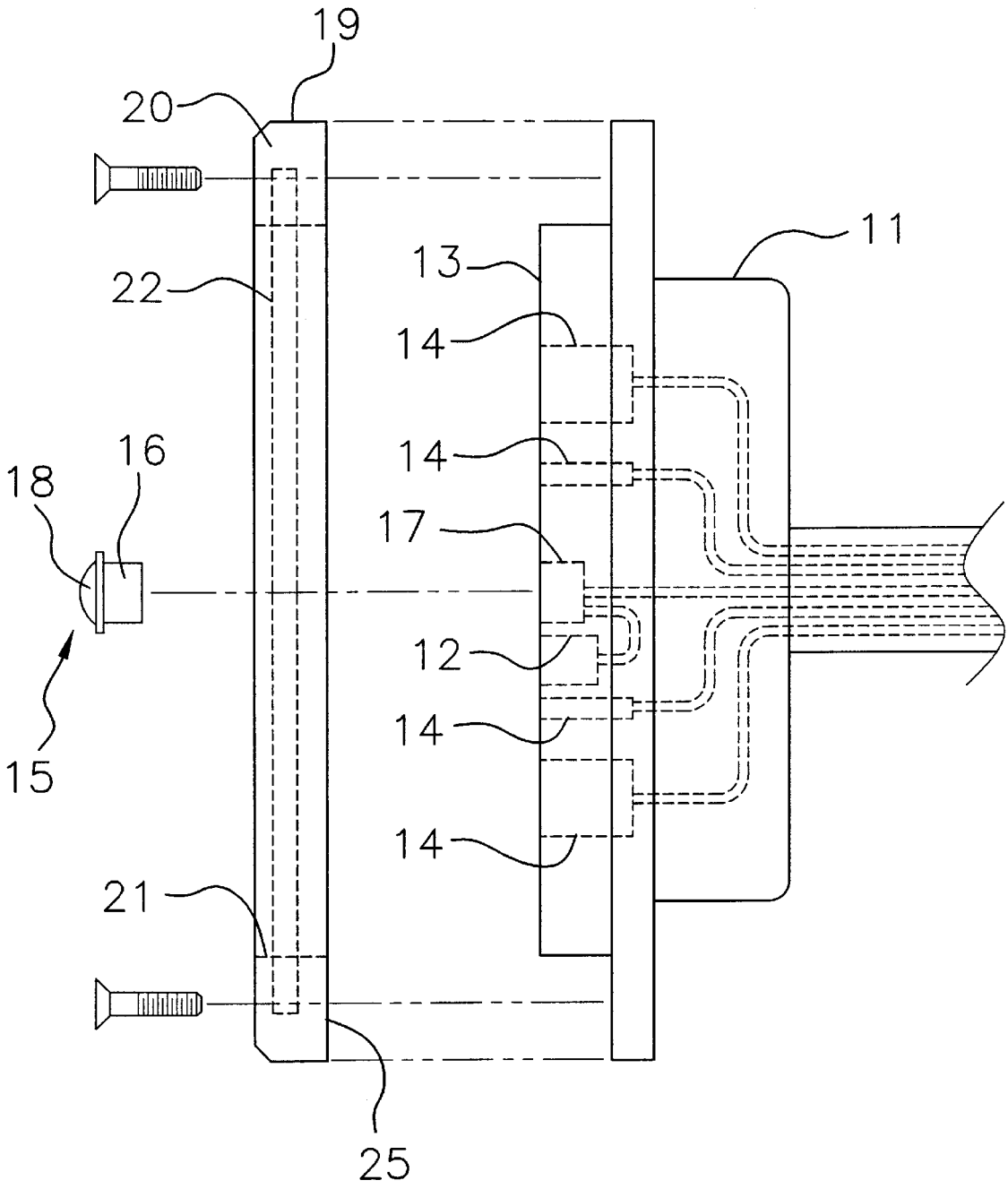
FIG. 2 is an exploded side view of the present invention.
Figure 3:
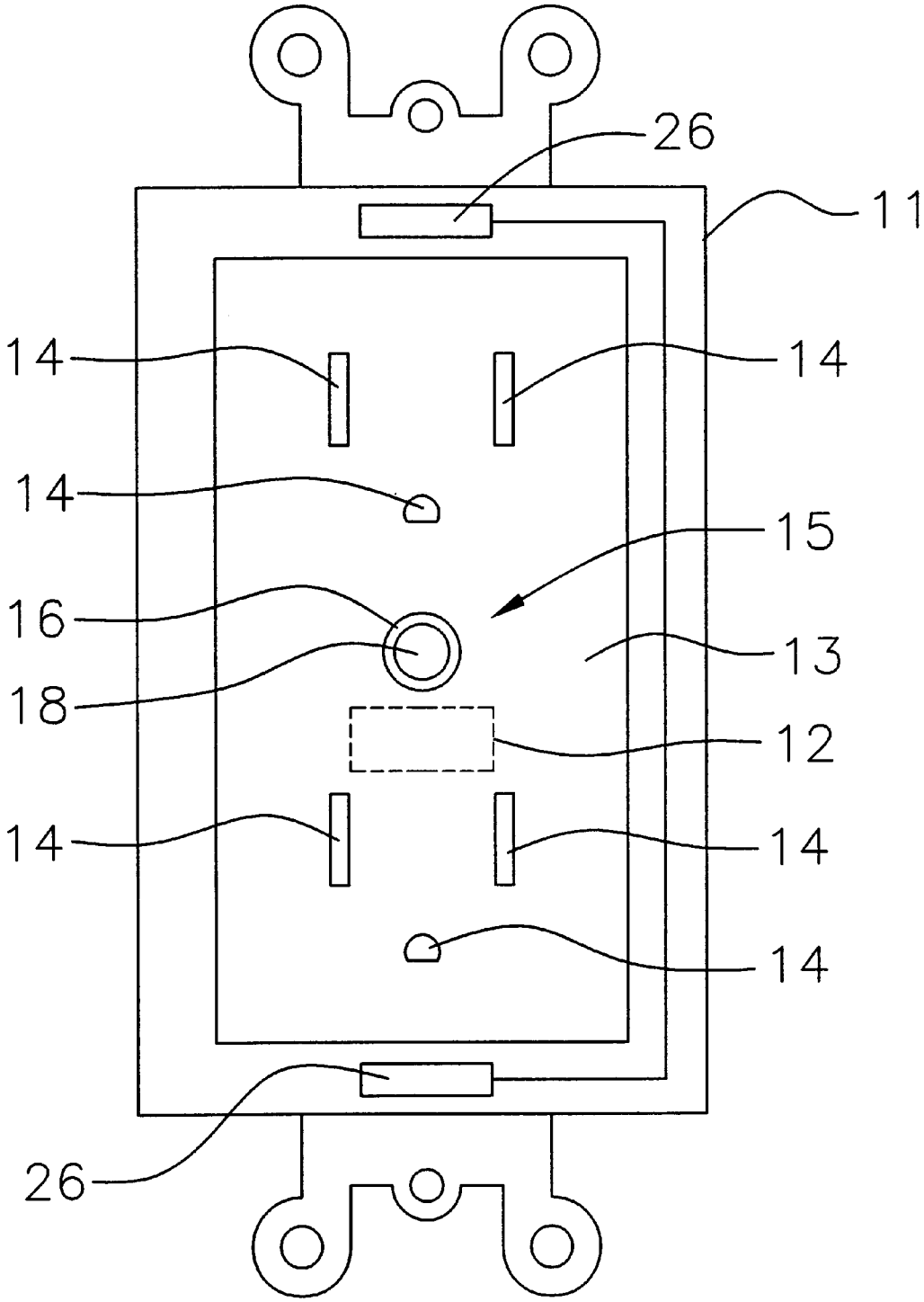
FIG. 3 is a front view of the body member of the present invention.
Figure 4:
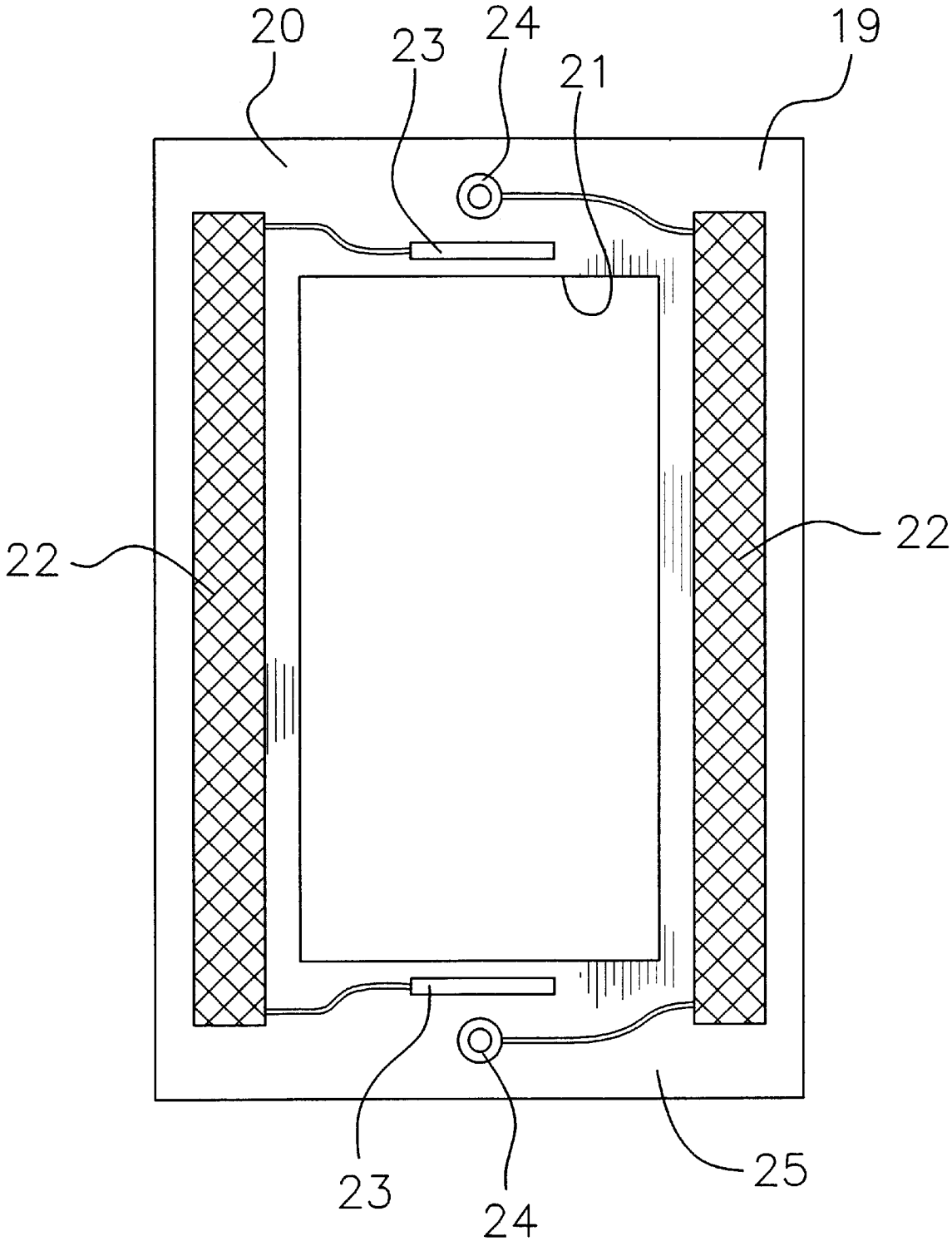
FIG. 4 is a rear view of the cover plate of the present invention.

With reference now to the drawings, and in particular to FIGS. 1 through 4 thereof, a new illuminated outlet embodying the principles and concepts of the present invention and generally designated by the reference numeral 10 will be described.

As best illustrated in FIGS. 1 through 4, the illuminated outlet 10 generally comprises a body member 11 having a light emitting member 12. The light emitting member 12 is operationally coupled to a power service for a building. The light emitting member 12 emits light to illuminate the body member 11 when the light emitting member 12 is supplied with power from the power service. The body member 11 is designed for coupling to a wall of the building. A face plate 13 of the body member 11 has a plurality of apertures 14. The apertures 14 are designed for operationally coupling to the power service whereby the apertures 14 are for permitting a plug of an appliance to be operationally coupled to the power service.

A switch assembly 15 is operationally coupled to the light emitting member 12. The switch assembly 15 is coupled to the body member 11. The switch assembly 15 is designed for controlling power from the power service to the light emitting member 12. The switch assembly 15 comprises a housing 16. The housing 16 of the switch assembly 15 selectively couples to a bore 17 of the body member 11 whereby the switch assembly 15 is replaceable should the switch assembly 15 become faulty. The switch assembly 15 comprises a light sensing member 18. The light sensing member 18 is designed for sensing a level of ambient light. The light sensing member 18 is for permitting power to be supplied to the light emitting member 12 when the light sensing member 18 senses the ambient light decline below a predetermined level.

A cover plate 19 is selectively coupled to the body member 11. The cover plate 19 is for enhancing aesthetic visual appearance of the body member 11 when the body member 11 is coupled to the wall of the building. The cover member has a perimeter wall 20. The perimeter wall 20 defines a central opening 21. The central opening 21 is for receiving the face plate 13 of the body member 11 such that the central opening 21 permits access to the face plate 13 of the body member 11 when the cover member is coupled to the body member 11.

The cover plate 19 has a plurality of light emitting portions 22. Each of the light emitting portions 22 is positioned within the cover plate 19. The light emitting portions 22 are designed for operationally coupling to the power service when the cover plate 19 is coupled to the body member 11. The light emitting portions 22 are designed for emitting light when the light emitting portions 22 are supplied power from the power service.

Each of the light emitting portions 22 has a supply contact 23 and a grounding contact 24. The supply contact 23 of each of the light emitting portions 22 is positioned on a rear face 25 of the cover plate 19. The supply contact 23 of each of the light emitting portions 22 is for engaging one of a plurality of positive contacts 26 operationally coupled to the switch assembly 15 on the body member 11 when the cover plate 19 is coupled to the body member 11. Each of the positive contacts 26 is designed for providing power to the light emitting portions 22 when the supply contact 23*s* engage a respective one of the positive contacts 26 and the light sensing member 18 senses the ambient light decline below the predetermined level. The grounding contact 24 of each of the light emitting portions 22 is for operationally communicating with the body member 11 when the cover plate 19 is coupled to the body member 11 for completing a circuit of the light emitting portion.

The face plate 13 and the cover plate 19 each comprises a semi-opaque material. The semi-opaque material of the face plate 13 is designed for softening the light emitted by the light emitting member 12 such that the light viewed through the face plate 13 of the body member 11 does not inhibit eye development of a user. The semi-opaque material is designed for softening the light emitted by the light emitting portion such that the light viewed through the face plate 13 of the body member 11 does not inhibit eye development of a user. The light emitting member 12 and the light emitting portions 22 emit a blue light that is easier on the eyes when viewed in the dark and thereby do not inhibit development of eyesight.

In use, the user connects the body member to the power service supplied to the house and then secures the body member to the wall. The light sensing member of the switch assembly then detects ambient light in the surrounding area and allows power to be supplied to the light emitting member when the surrounding area gets dark. The cover plate is coupled to the body member and the light emitting portions are operationally coupled to the light sensing member of the switch assembly. The light sensing member of the switch assembly allows power to be supplied to the light emitting member when the surrounding area gets dark. The face plate of the body member has a plurality apertures that permit the prongs of plug for an appliance to being inserted so that the appliance can be operationally coupled to the power service.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An illuminated outlet for providing light at night, the illuminated outlet comprising:

a body member having a light emitting member, said light emitting member being operationally coupled to a power service for a building such that said light emitting member emits light to illuminate said body member when said light emitting member is supplied with power from the power service, said body member being adapted for coupling to a wall of the building, a face plate of said body member having a plurality of apertures, said apertures being adapted for operationally coupling to the power service such that said apertures are for permitting a plug of an appliance to be operationally coupled to the power service;

a cover plate selectively coupling to said body member, said cover plate being for enhancing aesthetic visual appearance of said body member when said body member is coupled to the wall of the building; and said cover member having a perimeter wall, said perimeter wall defining a central opening, said central opening being for receiving said face plate of said body member such that said central opening permits access to said face plate of said body member when said cover member is coupled to said body member.

2. The illuminated outlet as set forth in claim 1, further comprising:

a switch assembly being operationally coupled to said light emitting member, said switch assembly being coupled to said body member, said switch assembly being adapted for controlling power from the power service to said light emitting member.

3. The illuminated outlet as set forth in claim 2, further comprising:

said switch assembly comprising a housing, said housing of said switch assembly selectively coupling to a bore of said body member such that said switch assembly is replaceable should said switch assembly become faulty.

4. The illuminated outlet as set forth in claim 2, further comprising:

said switch assembly comprising a light sensing member, said light sensing member being adapted for sensing a level of ambient light such that said light sensing member is for permitting power to be supplied to said light emitting member when said light sensing member senses the ambient light decline below a predetermined level.

5. The illuminated outlet as set forth in claim 1, further comprising:

said face plate of said body member comprising a semi-opaque material, said semi-opaque material being adapted for softening the light emitted by said light emitting member such that the light viewed through said face plate of said body member does not inhibit eye development of a user.

6. The illuminated outlet as set forth in claim 1, further comprising:

said cover plate having at least one light emitting portion, said light emitting portion being positioned within said cover plate, said light emitting portion being adapted for operationally coupling to the power service when said cover plate is coupled to said body member, said light emitting portion being adapted for emitting light when said light emitting portion is supplied power from the power service.

7. The illuminated outlet as set forth in claim 6, further comprising:

said light emitting portion having a supply contact and a grounding contact, said supply contact being positioned on a rear face of said cover plate, said supply contact being for engaging a positive contact on said body member when said cover plate is coupled to said body member, said positive contact being adapted for operationally coupling to the power service for providing power to said light emitting portion when said supply contact engages said positive contact, said grounding contact being for operationally communicating with said body member when said cover plate is coupled to said body member for completing a circuit of said light emitting portion.

8. The illuminated outlet as set forth in claim 6, further comprising:

a switch assembly being operationally coupled to said light emitting portion, said switch assembly being coupled to said body member, said switch assembly being adapted for controlling power from the power service to said light emitting portion.

9. The illuminated outlet as set forth in claim 8, further comprising:

said switch assembly comprising a housing, said housing of said switch assembly selectively coupling to a bore of said body member such that said switch assembly is replaceable should said switch assembly become faulty.

10. The illuminated outlet as set forth in claim 8, further comprising:

said switch assembly comprising a light sensing member, said light sensing member being adapted for sensing a level of ambient light such that said light sensing member is for permitting power to be supplied to said light emitting member when said light sensing member senses the ambient light decline below a predetermined level.

11. The illuminated outlet as set forth in claim 1, further comprising:

said cover plate comprising a semi-opaque material, said semi-opaque material being adapted for softening the light emitted by said light emitting portion such that the light viewed through said face plate of said body member does not inhibit eye development of a user.

12. An illuminated outlet for providing light at night, the illuminated outlet comprising:

a body member having a light emitting member, said light emitting member being operationally coupled to a power service for a building such that said light emitting member emits light to illuminate said body member when said light emitting member is supplied with power from the power service, said body member being adapted for coupling to a wall of the building, a face plate of said body member having a plurality of apertures, said apertures being adapted for operationally coupling to the power service such that said apertures are for permitting a plug of an appliance to be operationally coupled to the power service;

a switch assembly being operationally coupled to said light emitting member, said switch assembly being coupled to said body member, said switch assembly being adapted for controlling power from the power service to said light emitting member;

said switch assembly comprising a housing, said housing of said switch assembly selectively coupling to a bore of said body member such that said switch assembly is replaceable should said switch assembly become faulty;

said switch assembly comprising a light sensing member, said light sensing member being adapted for sensing a level of ambient light such that said light sensing member is for permitting power to be supplied to said light emitting member when said light sensing member senses the ambient light decline below a predetermined level;

a cover plate selectively coupling to said body member, said cover plate being for enhancing aesthetic visual appearance of said body member when said body member is coupled to the wall of the building;

said cover member having a perimeter wall, said perimeter wall defining a central opening, said central opening being for receiving said face plate of said body member such that said central opening permits access to said face plate of said body member when said cover member is coupled to said body member;

said cover plate having a plurality of light emitting portions, each of said light emitting portions being positioned within said cover plate, said light emitting portions being adapted for operationally coupling to the power service when said cover plate is coupled to said body member, said light emitting portions being adapted for emitting light when said light emitting portions are supplied power from the power service;

each of said light emitting portions having a supply contact and a grounding contact, said supply contact of each of said light emitting portions being positioned on a rear face of said cover plate, said supply contact of each of said light emitting portions being for engaging one of a plurality of positive contacts operationally coupled to said switch assembly on said body member when said cover plate is coupled to said body member, each of said positive contacts being adapted for providing power to said light emitting portions when said supply contacts engage a respective one of said positive contacts and said light sensing member senses the ambient light decline below the predetermined level, said grounding contact of each of said light emitting portions being for operationally communicating with said body member when said cover plate is coupled to said body member for completing a circuit of said light emitting portion; and said face plate and said cover plate each comprising a semi-opaque material, said semi-opaque material of said face plate being adapted for softening the light emitted by said light emitting member such that the light viewed through said face plate of said body member does not inhibit eye development of a user, said semi-opaque material being adapted for softening the light emitted by said light emitting portion such that the light viewed through said face plate of said body member does not inhibit eye development of a user.

* * * * *